US005329698A

United States Patent [19]

Abbott

[11] Patent Number: 5,329,698

[45] Date of Patent: Jul. 19, 1994

[54] METHOD OF ASSEMBLING A CATALYTIC CONVERTER

[75] Inventor: James R. Abbott, Jackson, Mich.

[73] Assignee: Tennessee Gas Pipeline Company, Lincolnsire, Ill.

[21] Appl. No.: 722,925

[22] Filed: Jun. 28, 1991

Related U.S. Application Data

[60] Division of Ser. No. 483,399, Feb. 22, 1990, Pat. No. 5,055,274, which is a continuation-in-part of Ser. No. 306,915, Feb. 2, 1989, abandoned.

[51] Int. Cl.[5] ..... B23P 15/00; F01N 3/28

[52] U.S. Cl. ..... 29/890; 29/890.08

[58] Field of Search ..... 29/890, 890.08; 60/299; 55/DIG. 30; 181/61, 227, 282; 422/170, 171, 177, 179, 180, 182

[56] References Cited

U.S. PATENT DOCUMENTS

| | | | |
|---|---|---|---|
| 3,498,407 | 3/1970 | Straw | 29/890.08 X |
| 3,523,590 | 8/1970 | Straw | 181/61 |
| 3,648,803 | 3/1972 | Heath et al. . | |
| 4,049,388 | 9/1977 | Scheitlin et al. | 23/288 FB |
| 4,163,042 | 7/1979 | Lynch | 422/179 |
| 4,218,422 | 8/1980 | Schock et al. | 422/171 |
| 4,239,733 | 12/1980 | Foster et al. | 422/179 |
| 4,347,219 | 8/1982 | Noritake et al. | 422/180 |
| 4,413,392 | 11/1983 | Otani et al. | 29/890 |
| 4,667,386 | 5/1987 | Enomoto et al. | 29/890 |
| 4,744,440 | 5/1988 | Hanson | 181/227 |
| 4,863,700 | 9/1989 | Eyck | 422/179 |
| 4,969,264 | 11/1990 | Dryer et al. | 29/890 |

*Primary Examiner*—Peter D. Vo
*Attorney, Agent, or Firm*—Harness, Dickey & Pierce

[57] ABSTRACT

A method of assembling a catalytic converter by inserting a catalyst substrate and surrounding support mat through the open end and into the central portion of an oval sheet metal tube, after which the reduced section and longitudinal ribs are formed in the central portion of the tube to compress the mat and securely engage the substrate, and the ends of the tube are pinched together to form sealed end closures with gas flow passages therein.

19 Claims, 2 Drawing Sheets

35
5
45
37
10
33
1
8
43
39
3
9
13
7
41
47
27
43
8
33
10
9

43
27
33
43
17
19
21
9
13
43
11
15
43

43
27
33
43
35
39
9
17
19
21
7
5
23
41
37
13
43
11
15
43

43
27
33
43
5
17
21
7
19
9
13
43
11
15
43

METHOD OF ASSEMBLING A CATALYTIC CONVERTER

CROSS-REFERENCE TO RELATED APPLICATIONS

This is a division of U.S. patent application Ser. No. 07/483,399, filed Feb. 22, 1990 entitled, "Catalytic Converter and Substrate Support with One Piece Housing" now U.S. Pat. No. 5,055,274 which is a continuation in part of copending application Ser. No. 07/306,915, filed Feb. 2, 1989, entitled, "Catalytic Converter and Substrate Support with One Piece Housing" now abandoned.

BACKGROUND OF THE INVENTION

This invention relates to catalytic converters useful in motor vehicle exhaust gas systems and, in particular, to converters of the type having one or more ceramic monoliths or substrates mounted inside of a sheet metal housing, the substrates containing a multiplicity of longitudinal straight-through-flow exhaust gas passages that are coated with catalyst. Such catalytic converters are intended for installation on motor vehicles as original equipment by the vehicle manufacturer or as aftermarket replacement for original equipment converters.

Typically, the metal housings for commercially acceptable converters of the type just described are of the so-called "pancake" or "clamshell" design; i.e., they comprise stamped upper and lower shells, which are substantially identical to each other, and which have mating, peripheral, side flanges that are welded together to lie in .a plane containing the longitudinal axis of the housing. They are shaped to form an internal chamber in which the substrates are mounted by "L-shaped" or other known brackets. Another commercial form of catalytic converter housing comprises a tube with separate end cones welded at each end; i.e., a three-piece housing.

It is a purpose of the present invention to reduce the size and number of parts in a catalytic converter (as compared with known practical constructions) while at the same time increasing its effectiveness and improving its construction and manufacture. The present invention achieves the foregoing purpose by means of a substrate support in the form of a tubular converter body which is reduced in diameter at a central portion to compress a support mat around a catalyst substrate. Such substrate support provides a construction and manufacture that results in a converter that is relatively short in length, has few parts, has maximum effectiveness since 100% of the substrate end faces can be used, and has improved accuracy in supporting the substrate.

It is also a purpose of the present invention to provide a converter of the type described above, and the method of making it, which has a one-piece, metal, tubular housing instead of a two-piece "clamshell" housing or the three-piece end cone type housing. A converter according to the invention performs at least as well as one having a prior type housing and has a construction that is inherently economical to produce and can be mass-manufactured in the large volumes required to supply original equipment converters directly to manufacturers of automobiles and trucks for factory installation in exhaust systems.

The present invention in preferred form involves the use of an open-ended oval metal tube. The catalyst coated ceramic substrate with a circumferential support mat is centrally placed inside of the oval tube. Thereafter, the central section of the oval metal tube is reduced in diameter to compress the mat and securely engage the substrate. During the diameter reducing process inwardly projecting longitudinal ribs are formed in the reduced section to maintain uniformity of reduction and mat compression. Annular raised ribs are formed near each open end of the tube and the open ends of the tube are pinched together by radial deformation to close the ends of the tube and form an inlet aperture in one end and an outlet aperture in the other end. In a preferred embodiment, the above procedure is used to position and secure two substrates in the housing, one being coated with three-way catalysts to convert nitrous oxides, carbon monoxide, and hydrocarbons and the other being coated with oxidation catalysts to convert carbon monoxide and hydrocarbons.

Other features and advantages of the invention will become apparent or be discussed in the detailed description.

DETAILED DESCRIPTION OF THE PREFERRED EMBODIMENTS

Figure 1:
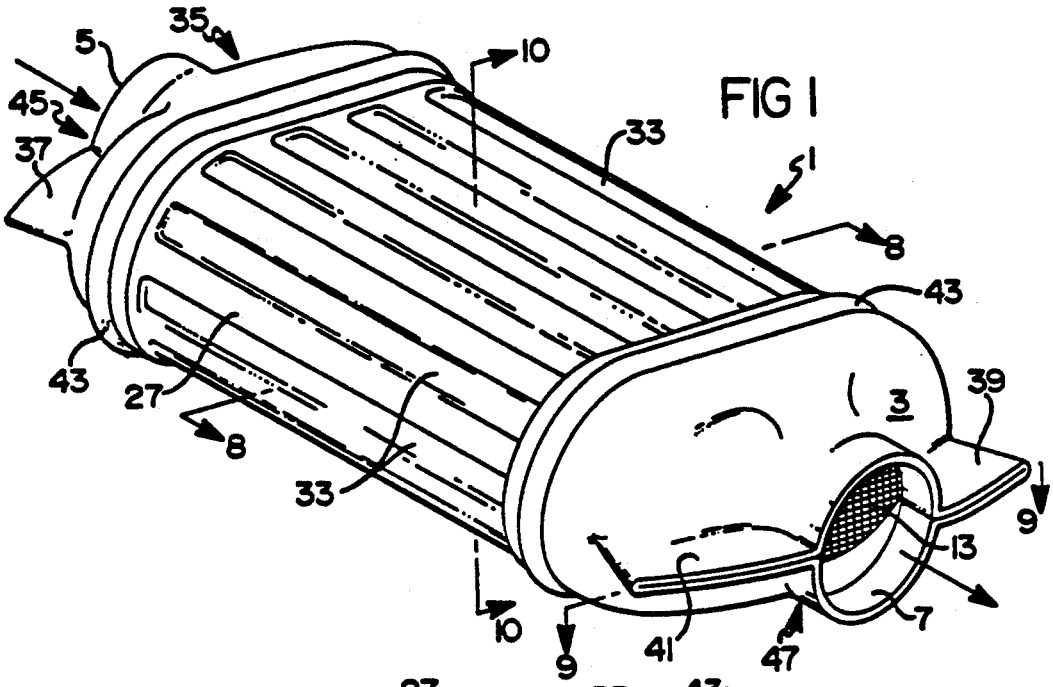
FIG. 1 is a perspective view of a catalytic converter according to the invention.

In accordance with the present invention, a catalytic converter 1 has a one piece, tubular metal housing 3 with an integral inlet 5 at one end and an integral outlet 7 at the other end. A first ceramic monolith, honeycomb-type, catalyst substrate 9 with circumferentially surrounding and narrower band-like support mat 11 is positioned inside of the housing 3 adjacent the inlet 5 end of the housing. A second substrate 13 with its circumferentially surrounding and narrower band-like support mat 15 is positioned inside of the housing 3 adjacent the outlet 7 end of the housing and is longitudinally separated from substrate 9. The substrates 9 and 13 are of the same but smaller cross section as the housing 3 and their outer peripheral surfaces are uniformly spaced radially inwardly from the inner wall of the housing. The ends of the support mats are located inwardly of the end faces of the substrates as shown in the drawings. The resilient and insulative shock absorbent support mats are composed of a gas impervious, vermiculite based material, available on the open market, which is intumescent and expands substantially upon heating. The support mats have a thickness of approximately ¼" which is radially compressed during assembly to approximately one-half of its initial thickness.

The substrates 9 and 13 subdivide the space inside of the housing 3 into three chambers; i.e., an inlet chamber 17 between the inlet 5 and the inlet side of the substrate 9, a central chamber 19 between the outlet side of substrate 9 and the inlet side of substrate 13, and an outlet chamber 21 between the outlet side of substrate 13 and the outlet 7. Though not illustrated, it is to be understood that each substrate has a great number of longitudinally extending straight-through-flow gas passages and that these are coated with appropriate catalysts. Thus, exhaust gas can flow straight through the converter i from inlet passage 5 to outlet passage 7, being treated as it flows through the longitudinal passages in the catalyst elements defined by substrates 9 and 13. The substrate 9 may contain three-way catalysts to convert nitrous oxides, carbon monoxide, and hydrocarbons to nitrogen, water, and carbon dioxide. The substrate 13 may contain an oxidation catalyst and secondary air may be supplied to chamber 19 to convert carbon monoxide and hydrocarbons to water and carbon dioxide. A secondary air inlet and conduit 23 is illustrated diagrammatically in FIG. 9.

According to the invention tooling (or dies) 25 is utilized to radially reduce in cross-section a central portion or annular ring 27 of the oval tubular housing 3. The tooling 25 is provided with spaced raised portions 31 that form spaced longitudinal ribs 33 in the reduced section 27 of the tubular body. In the preferred embodiment the ribs are substantially equally spaced circumferentially around the reduced portion of the housing 3 and the width of the longitudinal ribs and the space separating each adjacent pair of longitudinal ribs are substantially equal.

Preferably, the depth of the reduced section including longitudinal ribs is about half the thickness of the mats 11 and 15. This provides sufficient support to the substrates 9 and 13 yet still allows some relative movement of the substrates with respect to the housing (due to resiliency in the mats) without contact with the substrates. The longitudinal length of the ribs 33 and reduced section 27 are approximately the same as or slightly less than the longitudinal width of the mats 11 and 13 and the central chamber 19.

Radial reduction of the cross-section of a catalytic converter is disclosed in pending U.S. patent application Ser. No. 156,838, filed Apr. 1, 1988 (which is a division and continuation-in-part of application Ser. No. 873,684, filed Jun. 12, 1986 by inventors Leonard J. Dryer and Thomas J. Schwarte). Application Ser. No. 156,838, owned by the assignee of the present invention, is directed to a three-piece converter having a central reduced portion that is circular in cross-section and separate cones or bushings that are welded at each end. The radial reduction disclosed in Ser. No. 156,838, however, does not provide satisfactory uniform reduction in a converter housing that is oval in cross-section as in the present case.

Figure 9:
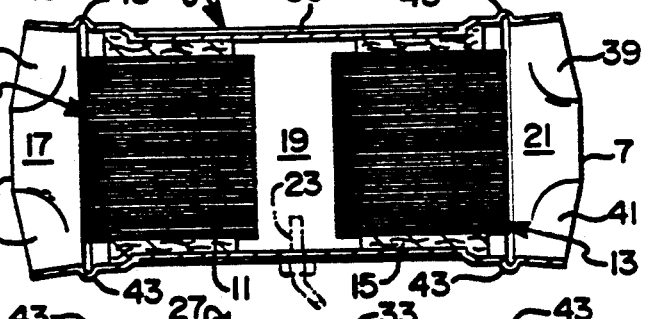
FIG. 9 is a view similar to FIG. 7 (and corresponds to a section along plane 9-9 of FIG. 1) showing the pinched down ends of the tube from which the converter housing is formed.
Figure 10:
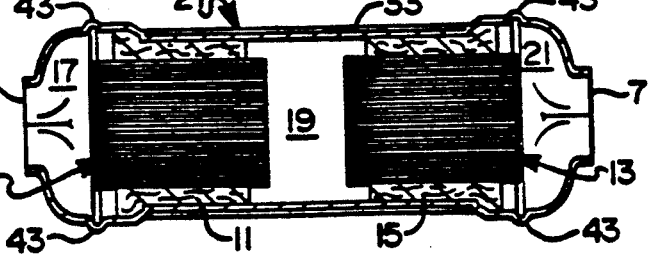
FIG. 10 is a cross section view along the line 10-10 of FIG. 1 showing the pinched down ends of the tube from which the converter is formed.
Figure 2:
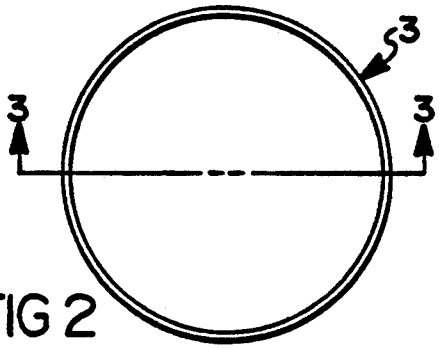
FIG. 2 is an end view of a round metal tube from which the housing of FIG. 1 may be fabricated.
Figure 4:
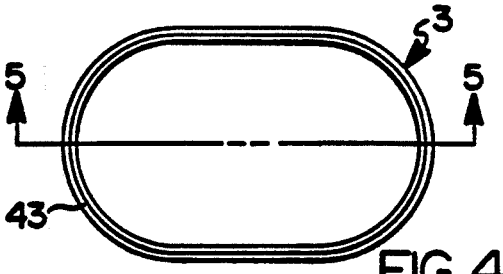
FIG. 4 is an end view of the tube of FIG. 1 after it has been shaped into an oval with a pair of outwardly projecting annular ribs former therein.

As seen in FIGS. 1, 9 and 10, at each end of the housing 3 opposite sides of the major diameter of the oval tube (the major diameter portions ordinarily being parallel to the bottom of the motor vehicle) are in engagement to close the ends of the housing. At the inlet end the opposite major diameter portions of the tubular housing 3 are radially deformed or squeezed together to produce the integral inlet passage 5 and the pinched-together corners 35 and 37 on opposite sides of the passage 5. The pinched corners 35 and 37 comprise a double thickness of metal and the two layers are preferably welded together to form and serve as closure means that seals the inlet end of the housing except for the formed passage 5. Similarly, at the outlet end the opposite major diameter portions of the tubular housing 3 are radially deformed to produce the integral outlet passage 7 and the pinched-together corners 39 and 41 on opposite sides of the passage 7. The two metal layers of the corners 39 and 41 are preferably welded together whereby they serve as closure means to seal the outlet end, of the housing except for the passage 7. Pinched-in end closures of this general type in exhaust gas mufflers are shown and described in U.S. Pat. No. 3,648,803 of Mar. 14, 1972 of Robert A. Heath and Ronald J. Martoia, owned by the assignee of the present invention.

Prior to radially deforming the ends of the housing 3 to form the pinched-in end closures and formed passages 5 and 7, an annular rib 43 is formed in the housing near each end of the housing 3 as shown in FIGS. 1, 4, 5, 9 and 10. While the annular rib 43 is preferably formed as a radially raised rib, it can also be formed to project inwardly into the housing 3 (in which case the substrates and mats are inserted into the housing before the annular ribs 43 are formed at each end of the housing). The annular ribs 43 serve to help maintain the oval shape of the housing 3 during the pinching operation and help control the extent of deformation to the housing. The annular ribs 43 furnish radial support to the ends of the housing 3 adjacent the substrates 9 and 13 during pinching down of the housing ends thereby helping to avoid crushing the corners of the adjacent substrates. Preferably ribs 43 are longitudinally located along housing 3 to correlate with the inlet end of substrate 9 and the outlet and of substrate 13. In this manner the overall length of the converter 1 is kept to a minimum and the adjacent ends of the fragile substrates 9 and 13 are protected from damage during crimping of the end closures.

Figure 6:
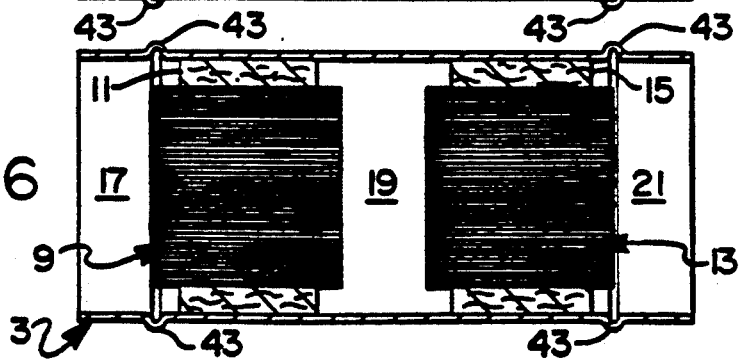
FIG. 6 is a view similar to FIG. 5 but shows two catalyst coated substrates wrapped with support mats inserted into the tube.

In general, a converter used in automatic exhaust systems may be of round or other cross sections, such as oval. The oval cross section illustrated herein is ordinarily preferred for automotive exhaust systems because the converter can be shaped to occupy minimum vertical space beneath the vehicle. In making the converter 1 of this invention it is convenient to start with commercially available round metal tubing of uniform diameter and metal thickness, open at both ends, and radially compress it from opposite sides with tubing dies to form the oval shape of FIG. 4. Thereafter, the annular ribs 43 are formed in the housing 3 to produce the configuration shown in FIG. 4. The substrates 9 and 13 with their centrally located peripheral support mats 11 and 15 are of the same outer oval size as the inside of the ovalized housing 3 and they are inserted into either or opposite open ends of the housing until they are properly placed in their predetermined location within the housing. Preferably, they are inserted into opposite open ends of the housing until the outer ends of substrates 9 and 13 align with the ribs 43 as shown in FIG. 6.

The next step is to radially uniformly reduce the central portion of the housing 3 by suitable known means into a reduced diameter or ring portion 27 of a length slightly less than the longitudinal length of the housing occupied by the mats 11 and 15 and the central chamber 19. As a result of substantially uniformly radially compressing the mats 11 and 15 around the outside of the substrates 9 and 13, respectively, to about one-half the original or free state thickness of the mats, substrates 9 and 13 are firmly though somewhat resiliently supported centrally within the housing 3. The reduced portion 27 comprises a plurality of radially inwardly projecting longitudinal ribs 33 that are preferably circumferentially uniformly spaced about the housing 3. Ribs 33 furnish structural rigidity and stiffness to the reduced portion 27 and generally to the housing 3. Ribs 33 also help maintain reduced portion 27 in its uniformly reduced oval cross-section, thereby helping to maintain uniform radial compression on the mats 11 and 15. In this manner both reduced portion 27 and mats 11 and 15 apply sufficient radial pressure to retain the substrates 9 and 13 in their predetermined position and serve as the sole means to shock mount and support the substrates.

Figure 7:
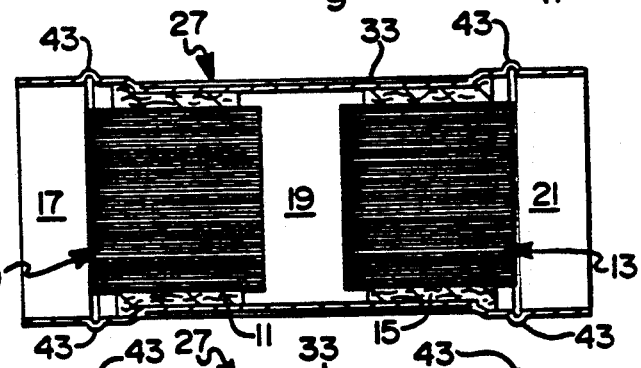
FIG. 7 is a view similar to FIG. 6 but shows the reduced diameter portion and longitudinal ribs formed in the reduced portion holding the substrates in place.

After formation of the reduced portion 27 and the ribs 33 so that the substrates 9 and 13 are securely held in place, the inlet end closure 45 (comprising corners 35 and 37 and inlet passage 5) and the outlet end closure 47 (comprising corners 39 and 41 and outlet passage 7) are formed. Axial pressure parallel to the short diameter of the oval housing 3 is applied to the ends of the housing to deform them together into the pinched end closures 45 and 47 while still maintaining the remainder of the oval housing cross section to preserve the clearance between the housing 3 and the outer edges of the substrates 9 and 13. While the reduced portion 27 including longitudinal ribs 33 can be formed in the housing 3 before the end closures are formed, as shown in FIG. 7, it is possible to simultaneously press-form the reduced portion 27 including the longitudinal ribs 33, and the end closures 45 and 47 thereby eliminating one operation.

Further, the end closures 45 and 47 can be formed one end at a time or both simultaneously. Since at least one embodiment of the converter is symmetrical, the same tooling can be used to form one end at a time; it being necessary only to simply reverse the housing end for end to perform the desired operation.

Figure 8:
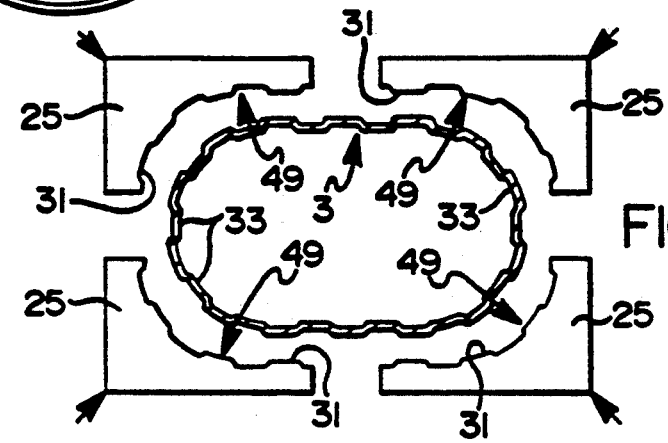
FIG. 8 is an enlarged section along the line 8—8 of FIG. 1 and shows the tooling used to form the reduced portion and longitudinal ribs.
Figure 3:
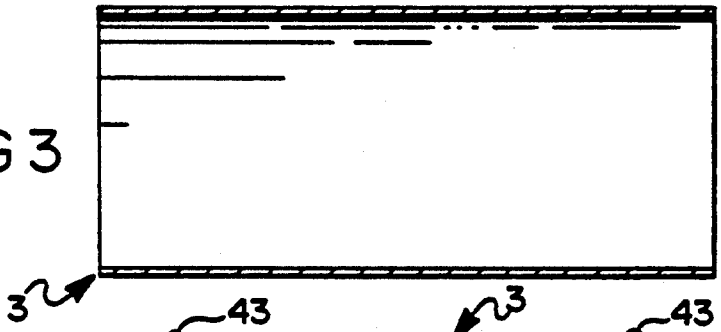
FIG. 3 is an enlarged section along the line 3—3 of FIG. 2 showing that the tube is of uniform diameter and thickness and has smooth walls.
Figure 5:
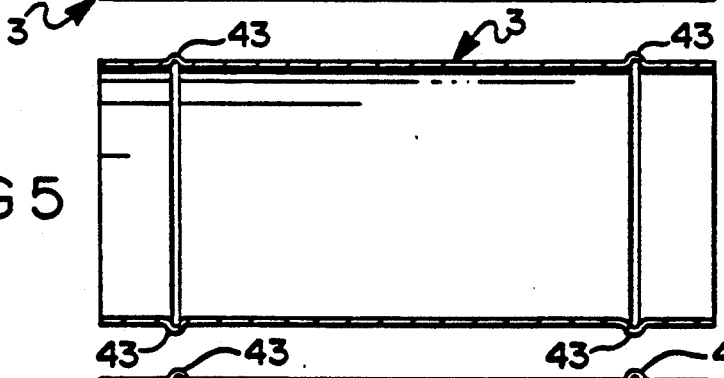
FIG. 5 is an enlarged section along the line 5—5 of FIG. 4.

In FIG. 8, four compression dies 25 each having a curvilinear forming surface 49 conforming to one quarter of the general oval cross sectional configuration of the housing 3, are positioned about and simultaneously driven radially inwardly (as shown by arrows) about the central portion 27 of the housing 3 thereby resulting in the housing wall being substantially uniformly radially deformed and driven into compressing contact with the mats 11 and 15. The axial width of each forming surface 49 is selected to be substantially equivalent to the predetermined longitudinal length of the reduced portion 27 desired. The forming surfaces 49 of the dies 25 include a plurality of the spaced raised portions 31 which form the longitudinal ribs in reduced annular ring portion 27 during the reducing operation. Preferably the angular extent of surfaces 49 is such that when the compression dies 25 reach their inwardmost travel the respective surfaces 9 cooperate to define a continuous 360° surface. Advantageously, the dies 25 assure that mats 11 and 15 are properly reduced in thickness and compressed radially between the substrates and the inner wall of the housing tube.

In use, the converter i would normally be secured into an exhaust system by welding or clamping of exhaust system conduits to the inlet 5 and outlet 7 defined by end closures 45 and 47, respectively. Exhaust gas flows through the longitudinal passages of the substrates which are catalyst coated to reduce oxides of nitrogen and to oxidize hydrocarbons and carbon monoxide in order to achieve acceptable emission levels. If a vermiculite base mats 11 and 15 are used, heat from the reaction during initial operation of the converter will cause the mats to significantly expand thereby, enhancing the tightness of the connection between the substrates 9 and 13 and the housing 3 to act along with the relatively high frictional resistance to resist slipping of the substrates relative to the housing 3. For use in either original equipment or in the aftermarket, the substrates of the converter 1 will be selected, sized, and treated with catalyst to produce acceptable emission levels for a wide variety of different engines.

As an example of approximate size for present day U.S. automotive applications, the substrates 9 and 13 may vary from approximately 1" to approximately 6" long and, depending on the size of the converter, have oval diameter ranges of approximately 3.15" to 4.15" in the short diameter and approximately 4.75" to 6.60" in the long diameter. The substrates are uniformly spaced about ⅛" from the inner surface of the reduced portion 27 and about ¼" from the inner surface of non-reduced portions of the housing 3. The overall length of the housing 3 after forming of the pinched ends may be approximately 15 to 15½" for one embodiment of converter 1. This length can be significantly less than that needed to support the substrate in a conventional manner in a similarly shaped body by means of L-shaped support rings or brackets. Additionally, 100% of the end faces, and therefore the longitudinal passages, of the substrate can be used for exhaust gas flow treatment, thereby increasing the converter's effectiveness.

Since the mats 11 and 15 are heated when used in an exhaust system and expand to such a degree that they tightly hold the substrates in place, the need for conventional mechanical assistance, L-rings, ribs, or partitions to hold the substrates is eliminated. Accordingly, the converter i has a minimum number of parts, only three if only one substrate and mat are used, and the method of supporting the substrate by uniform radial compression applied through reduced portion 27 promotes accuracy and efficiency in manufacturing. The converter 1 can be shipped with reduced likelihood of impact damage to the brittle ceramic substrate material because of the protection provided by the pinched ends and by the unique method of mounting the substrate which provides clearance for the corners of the substrate.

The engagement of each combined substrate and mat with the housing is such as to permit them to be longitudinally inserted into the housing 3. Ordinarily, the peripheral outer surface of the substrates that engages the mat is rough so that the mat does not tend to slip longitudinally along the substrate even before heat expansion radially compresses it against the outer substrate surface. However, the inner wall of housing 3 is smooth and there is a possibility of slippage between the outer surface of the mat and the housing until heat is applied to and the mat expands. The pre-heat condition exists during the period between manufacture and actual use on a vehicle. During this period much handling of the converter occurs. Slippage at the interface between the mat and housing is avoided, however, by the holding means provided by the reduced portion 27 and the longitudinal ribs 33. Ribs have been used heretofore in converters with "clamshell" housings in conjunction with metal mesh type substrate supports to help hold the supports in place during actual use of the converter. In the present invention, radial compression of the support mats as a result of both the reduced portion 27 with longitudinal ribs 33 and heat expansion holds them in place during actual use of the converter.

The converter illustrated contains two separate catalyst elements. One of the elements could be omitted so that the converter would contain just one catalyst member but still embody the one piece housing and reduced portion with longitudinal rib construction described herein.

While the converter 1 is shown as symmetrical about a longitudinal axis through the center line of passages 5 and 7, it will be recognized that the structure and method described would also enable one or both passages to be transversely offset from the longitudinal axis. Further, if desired, a known type of heat shield may be attached to the converter housing 3 by welding or otherwise.

Modifications may be made in the specific features shown and described without departing from the spirit and scope of the invention.

What is claimed is:

1. A method of assembling a catalytic converter for use in a motor vehicle which comprises providing a catalyst substrate having a mid-section, assembling a thin radially compressible shock absorbent annular support mat around the mid-section of the catalyst substrate to form a preassembly, inserting the preassembly into a hollow one-piece cylindrical metal body extending longitudinally so as to be in centered spaced relation to the interior wall of said body, thereafter, radially deforming a central wall portion of said metal body by a first amount to form a radially inwardly compressed section in contact with said annular support mat and by a second amount to form longitudinal ribs extending radially inwardly from said compressed section so as to be in radial contact with said annular support mat whereby to apply and retain radial pressure on and radially compress said support mat to substantially reduce its thickness and to apply sufficient radial pressure against said substrate to hold said catalyst substrate in said body.

2. A method as set forth in claim 1 including the added step of applying radial pressure to an outer end of said body to radially deform said outer end inwardly into an end portion of predetermined shape.

3. A method as set forth in claim 1 wherein said preassembly is inserted into said body so that said preassembly is substantially longitudinally and axially centered in said body and wherein a central portion of the wall of said body is deformed into said compressed section.

4. A method according to claim 28 wherein said body and said substrate are oval in cross section.

5. In a method of assembling a catalytic converter of the type including a hollow tube having a central portion and opposite end portions at opposite longitudinal ends of the tube, a catalyst having an outer periphery and a mid-section, and a resilient annular support member radially sandwiched between the inner wall of the tube and the outer periphery of the catalyst, the improvement comprising the steps of assembling said support member about the mid-section of said catalyst and inserting the assembly into said tube such that the assembly is disposed in the central portion of said tube and between the opposite end portions thereof, and thereafter radially deforming said central portion into contact with the outer periphery of the support member whereby to compress the support member against the catalyst and deforming each of said end portions such that each said end portion is formed into a laterally flattened end with a gas flow opening, said central portion being reduced generally uniformly about the assembly and formed with longitudinal ribs extending radially inwardly from said central portion and into direct engagement with the support member, the deforming to reduce the thickness of said support member by an amount sufficient to apply radial pressure against said support member and thereby securely hold said catalyst in said tube.

6. A method as recited in claim 5 wherein said tube and said catalyst are oval in cross section.

7. A method as recited in claim 5 wherein said central portion is reduced before said end portions are formed.

8. A method as recited in claim 5 wherein said support member is a generally nonmetallic gas impervious material.

9. A method as recited in claim 8 wherein said support member is a material such as vermiculite that expands upon being subjected to heat.

10. A method as recited in claim 5 wherein said catalyst is generally cylindrical and has opposite axial end faces, and wherein said assembling step comprises axially positioning said support member on said catalyst such that axial edges of said support member are axially inward from each said axial end face of said catalyst.

11. A method of assembling a catalytic converter which comprises providing a sheet metal cylindrical tube having a central portion and an open end, forming an outwardly projecting annular rib in the wall of said tube adjacent to said open end, inserting a monolith type catalyst member having an outer periphery into said open end of said tube and positioning said catalyst member longitudinally in the central portion of said tube, thereafter deforming the central portion of said tube whereby to form a reduced diameter central portion comprising a first portion compressed radially inwardly by a first predetermined amount into engagement with the outer periphery of the catalyst member and a plurality of longitudinally extending and radially inwardly projecting second portions extending radially inwardly from said first portion by a second predetermined amount and making line contact engagement with the outer periphery of said catalyst member to hold said catalyst member in longitudinal position within said tube, and closing said open end of said tube except for a gas flow passage by pressing opposite sides of said open end of said tube together to form a double metal layer end closure containing a gas flow passage.

12. A method of assembling a catalytic converter as set forth in claim 11 wherein said providing step includes said tube being open at each end of said tube, and further comprising pressing each of the ends of said tube to form said end closures at each end of said tube and simultaneously deforming said central portion of said tube to hold said catalyst member.

13. A method of assembling a catalytic converter as set forth in claim 11 wherein said catalyst member and said tube are oval in cross section.

14. A method of assembling a catalytic converter containing a preassembly of a monolith type catalyst element and a compressible support mat wrapped around the element, said support mat being adapted to undergo a reduction in thickness from a free state to a compressed state and having an outer periphery, the method which comprises inserting the preassembly into an open end of an elongated open-ended sheet metal tube and longitudinally positioning said preassembly in the center of said tube, radially inwardly deforming a central portion of said tube that extends longitudinally and is substantially contiguous with said support mat so that said deformed central portion is substantially in engagement with the outer periphery of said support mat and forces said mat into its compressed state, radially inwardly deforming said deformed central portion to form a plurality of ribs extending longitudinally and engaging said support mat, and closing said open end of said tube except for a gas flow passage.

15. A method of assembling a catalytic converter as set forth in claim 14 wherein said catalyst member and said tube are oval in cross section.

16. The method of making an oval catalytic converter containing a monolith type catalyst element having a support mat wrapped around its outer periphery which comprises pressing a round open-ended one-piece sheet metal tube into an oval shape, pressing an outwardly projecting annular oval rib into the wall of said tube at a predetermined location near the open end of said tube, inserting the combined catalyst element and support mat into said open end of said tube to a predetermined location in a substantially central portion of said tube, radially deforming the portion of said tube that substantially corresponds with the outer periphery of said support mat so that said deformed portion is substantially in engagement with said outer periphery of said support mat, forming a plurality of longitudinal and radially inwardly projecting ribs in said radially deformed portion of said tube, and closing the open end of said tube except for a gas flow passage by pressing opposite sides of said end of said tube together to form a double metal layer end closure containing a gas flow passage.

17. A method of making a catalytic converter containing two monolith type catalyst elements each having a support mat wrapped around its outer periphery, the steps comprising pressing a round sheet metal tube into an oval shape and open at each end, forming a raised annular rib into the wall of said tube near each open end, inserting one combined catalyst element and support mat into one open end of said tube and moving it longitudinally to a predetermined position between said annular ribs within a substantially central portion of said tube, inserting the other combined catalyst element and support mat into the other open end of said tube and moving it longitudinally to a predetermined position between said annular ribs within said central portion and spaced from said one combined catalyst element and support mat, thereafter radially reducing the cross section of said central portion of said tube and forming a plurality of angularly spaced longitudinally extending and radially inwardly projecting ribs in said central portion so that said deformed central portion is substantially in engagement with the outer periphery of both said support mats, and pressing opposite sides of said ends of said tube together outside of said radial ribs to form an end closure at one end containing an inlet gas flow passage and an end closure at the other end containing an outlet gas flow passage.

18. The method of making a catalytic converter as set forth in claim 17 wherein each said combined catalyst element and support mat is longitudinally inserted into said tube until the trailing edge of said catalyst element is in substantial alignment with the said raised annular rib that is closest to said end of said tube into which said combined catalyst element and support mat is inserted.

19. A method of manufacturing a catalytic converter, comprising the steps of providing a one-piece tubular housing having a generally uniform cross-section disposed along a longitudinal axis and opposite ends, forming a raised, generally annular, radially outwardly projecting rib in the housing adjacent to and at a location axially inward from each of said housing ends, said forming step disposing each of said ribs in a plane generally perpendicular to said axis and dividing the housing into a central portion and a pair of end portions, mounting a catalyst means into said central portion, said catalyst means disposing first and second end faces along said axis and axially inward of a respective rib, and pinching each of said end portions of said housing whereby to cause the end material of each said housing end portion to be flattened together to close the end of the housing and extend transversely of said axis and to form a gas flow opening, said ribs inhibiting the cross-section of said central portion from deforming during the flattening of said end portions.

* * * * *